US010462571B2

(12) United States Patent
White, III et al.

(10) Patent No.: US 10,462,571 B2
(45) Date of Patent: Oct. 29, 2019

(54) CHAIRS WITH WIRELESS SPEAKER SYSTEM

(71) Applicant: Gabriella White, LLC, Pelham, AL (US)

(72) Inventors: William Bew White, III, Pelham, AL (US); Matt Scallions, Pelham, AL (US)

(73) Assignee: Gabriella White, LLC, Pelham, AL (US)

( * ) Notice: Subject to any disclaimer, the term of this patent is extended or adjusted under 35 U.S.C. 154(b) by 0 days.

(21) Appl. No.: 15/645,755

(22) Filed: Jul. 10, 2017

(65) Prior Publication Data

US 2019/0014415 A1 Jan. 10, 2019

(51) Int. Cl.
*H04R 5/02* (2006.01)
*H04R 1/02* (2006.01)

(52) U.S. Cl.
CPC ..... *H04R 5/023* (2013.01); *H04R 1/025* (2013.01); *H04R 2420/07* (2013.01)

(58) Field of Classification Search
CPC ..... H04R 5/02; H04R 5/023; H04R 1/028; H04R 2201/02; H04R 2201/028; H04R 2201/029; H04R 2201/023; H04R 2499/11; H04R 2499/13; H04R 2499/15
USPC ..... 381/300, 301, 302, 304, 305, 332, 333, 381/386, 388, 389, 391, 395, 189, 397, 381/398; 700/94
See application file for complete search history.

(56) References Cited

U.S. PATENT DOCUMENTS

| | | | | |
|---|---|---|---|---|
| 3,230,320 | A | 1/1966 | Kerr | |
| 3,452,836 | A | 7/1969 | Carsello et al. | |
| 6,135,551 | A | 10/2000 | Linder | |
| 7,125,074 | B2 | 10/2006 | Real et al. | |
| 7,130,440 | B2 | 10/2006 | Maekawa et al. | |
| 7,431,392 | B2 | 10/2008 | Tamara | |
| 8,000,484 | B2 | 8/2011 | Rasmussen | |
| 8,221,246 | B2 | 7/2012 | Lee et al. | |
| D691,586 | S | 10/2013 | Clark | |
| 8,678,936 | B2 | 3/2014 | Lesley et al. | |
| 2004/0217632 | A1 | 11/2004 | Glassman | |
| 2004/0245809 | A1 | 12/2004 | Glassman | |
| 2006/0284459 | A1 | 12/2006 | Real et al. | |
| 2008/0100107 | A1 | 5/2008 | Paslawski | |
| 2010/0320819 | A1* | 12/2010 | Cohen | A61H 23/0236 297/217.4 |
| 2011/0123038 | A1 | 5/2011 | Clark | |
| 2013/0238829 | A1* | 9/2013 | Laycock | H04R 1/1033 710/303 |
| 2016/0119700 | A1* | 4/2016 | Miskin | H04R 5/023 381/333 |

FOREIGN PATENT DOCUMENTS

| | | |
|---|---|---|
| WO | 2009079603 | 6/2009 |
| WO | 2009113319 | 9/2009 |
| WO | 2014182851 | 11/2014 |

* cited by examiner

*Primary Examiner* — Leshui Zhang
(74) *Attorney, Agent, or Firm* — Thomas G. Peterson; Maynard Cooper & Gale

(57) ABSTRACT

An audio and seating system is disclosed for one or more chairs comprising at least one wireless speaker.

18 Claims, 6 Drawing Sheets

CHAIRS WITH WIRELESS SPEAKER SYSTEM

CROSS-REFERENCE TO RELATED APPLICATIONS

This application claims priority to and the full benefit of U.S. patent application Ser. No. 29/605,065 filed on May 23, 2017 (currently pending), which is incorporated herein by reference in its entirety.

BACKGROUND

There is a need for sound, especially music, to be integrated tastefully and unobtrusively into a setting where people relax, work or play. In some settings, such as inside existing buildings, audio devices and speakers would be either impossible or very costly to install in a way which is unseen. Or, in an outside setting speakers can be needed in areas which are difficult to connect by wires such as on a patio detached from a house or building. The revolution of the last few years in making stylish fabrics more durable and weatherproof has created the ability for fine furniture to stay outside in the elements for an entire season, unlike the older fabrics based on cotton which are not durable at all. Finally, the revolution in microelectronics and wireless communications can now be joined with the foregoing trends to create new systems for the enjoyment and appreciation of music in settings where it was either difficult to do so, or obtrusive.

Furniture can be positioned on a patio, balcony, deck, garden, or beach which is out of range of audio speakers or an electrical source housed in a home or building. Users in these sorts of locations who want music or other audio would not want to be troubled to run power cords to such an area for audio equipment, or to set up free-standing audio speakers which would be completely open to the sun and to precipitation.

Although there have been pieces of furniture provided with speakers housed in them, they have not been suitable for bathing an entire area with stereophonic sound. For example, there have been chairs with speakers, but two speakers on a single chair would not provide a truly superior audio system which saturates the environment in sound, but would be localized to one place within the area.

Also, there is a desire for audio speakers to be hidden from view so that the sound seems to emanate from the furniture itself.

There are also some situations for which a user might need a wireless speaker hidden in a single chair, so the speaker should be out of sight and capable of being removed in the event of cold or rainy weather.

As used herein, "chair" or "seat" includes any piece of furniture for sitting including a chair or seat for one person, or a sofa, couch or other furniture for more than one person.

As used herein, "seatback cover" includes either a slipcover fitting loosely over a chair, or upholstery attached directly to a seatback.

DETAILED DESCRIPTION

Figure 1:
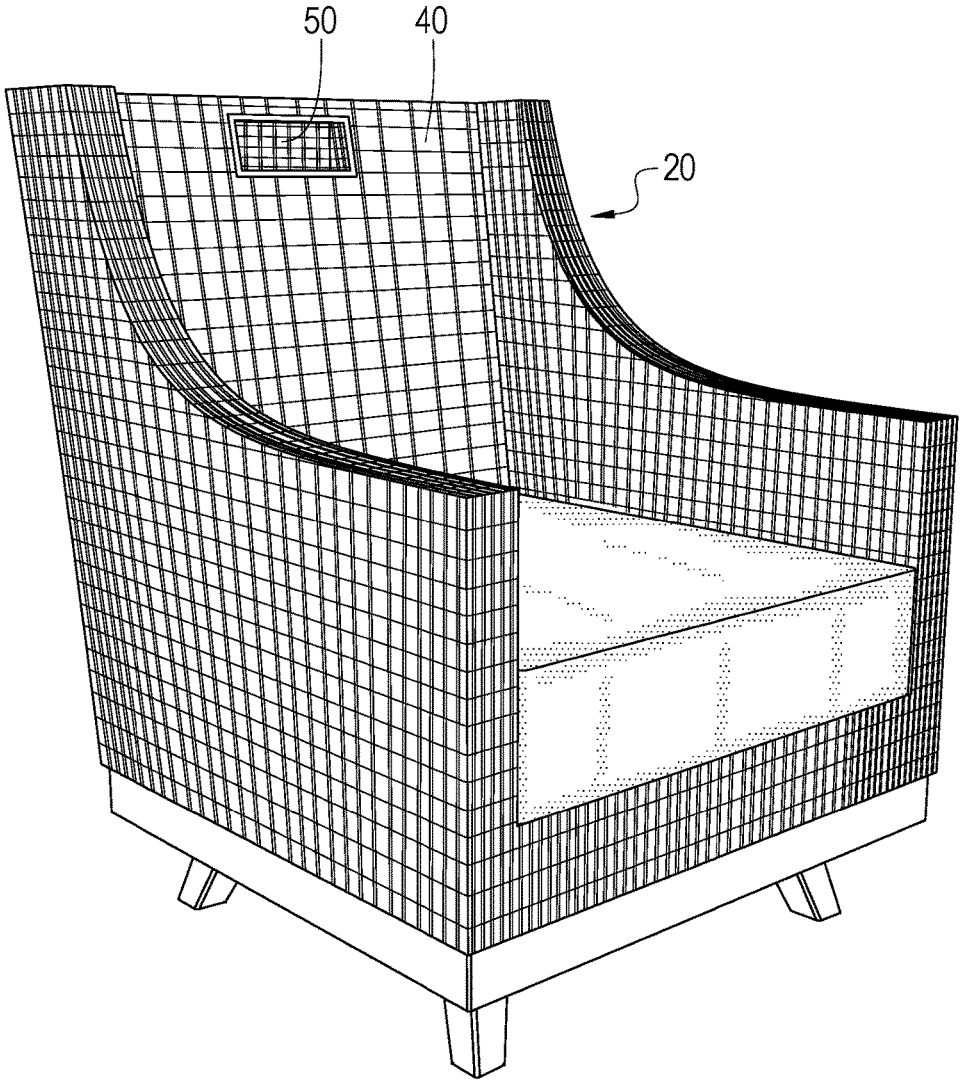
FIG. 1 shows a chair having an inset space, with the cushion for the seatback not being shown.

FIGS. 1-4 illustrate one or more chairs 20 of the present disclosure which have a number of different configurations and embodiments. According to an exemplary embodiment shown in FIG. 1, a chair 20 comprises a seat 30 and a seatback 40, said seatback 40 comprising an inset space 50 positioned, in one embodiment, in a center of said seatback 40 approximately at shoulder blade level of a user when seated, said inset space 50 open toward the seatback cushion. The inset space 50 can also be located in any other convenient location in the chair 20.

Figure 2:
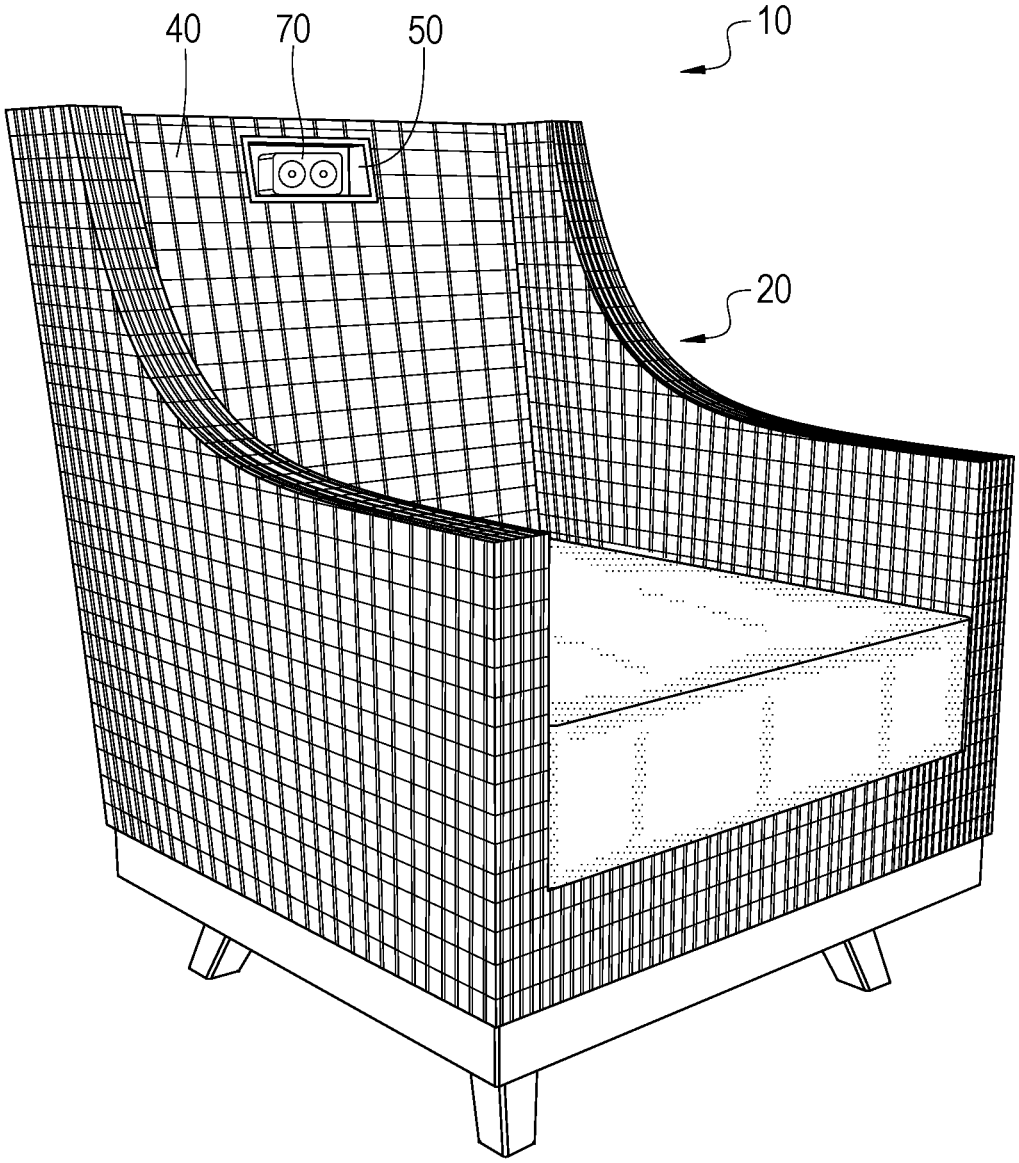
FIG. 2 shows a chair having an inset space which houses a wireless speaker, with the cushion for the seatback not being shown.

An embodiment shown in FIG. 2 shows a seating and audio system 10 comprising a chair 20 comprising a seatback 40 and a wireless speaker 70, said seatback 40 comprising an inset space 50, said inset space 50 open on the seatback 40 side where the user's back rests when seated, and said wireless speaker 70 positioned in said inset space 50 and capable of communicating wirelessly with a separate audio device 80, so that said wireless speaker 70 is capable of providing sound while hidden from view when communicating wirelessly with audio device 80. In another embodiment, the inset space 50 may be positioned in another location such as, by way of example only, the rear of the seatback facing away from the person seated in the chair. The audio device 80 may be separate from the chair 20 or it may be included as part of the seating and audio system 10. The chair may also include a sofa, loveseat, or any other furniture designed for seating. The chair 20 may be any chair comprising a seatback 40 including, without limitation, an Adirondack chair, a beach chair, a chaise lounge, a patio chair, a club chair, a rocking chair, and a deckchair. The chair 20 can be made of any material suitable for use including, without limitation, aluminum, plastic, polymer, resin, steel, wicker, rattan, wood, and wrought iron. The chair 20 may or may not have arms. The chair 20 further comprises legs and a seat 30 and optionally comprises arms, rocker elements, and any other traditional elements associated with a chair 20. The seatback 40 may be a seatback of any kind. The seatback 40 may be of any construction, whether open or closed, such as for example, solid construction, caning, mesh, or woven construction (e.g., wicker).

The inset space 50 housing a wireless speaker 70 can be any shape suitable for housing a wireless speaker 70, such as circular, spherical, rectangular, or square. The inset space 50 may have any dimensions capable of housing a wireless speaker 70. It is preferable that the inset space 50 be readily accessible. In one embodiment, the inset space 50 may be open from the top, corresponding to the top of the seatback 40. In one embodiment, the inset space 50 may be open from the side, corresponding to the side of the seatback 40. In one embodiment, the inset space 50 may be open from the back, corresponding to the back of the seatback 40. In another embodiment, the inset space 50 is open on the side corresponding to the seatback 40.

In one embodiment, at least one of the inset spaces 50 is in a center of a seatback 40. In another embodiment the inset space 50 is located at or around the shoulder blade level of a user seated in the chair 20. By locating the inset space 50 at or around the shoulder blade level of a user, this allows coverage of the speaker 70 by the seatback cushion 60. In a further embodiment, at least one of the inset spaces 50 comprises a bladder of waterproof material 90 comprising a closeable panel 100 opening toward the seatback 40, so that at least one of the wireless speakers 70 is capable of being protected during inclement weather when the closeable panel 100 is closed.

According to the exemplary embodiments shown in FIGS. 1-2, the wireless speaker 70 is housed within the inset space 50 located in the seatback 40 of the chair 20. A wireless speaker 70 is a speaker 70 that receives audio signals using radio frequency rather than by means of conventional audio cables. Non-limiting examples of radio frequencies that support audio transmission to wireless speakers 70 include Wi-Fi and Bluetooth. Non-limiting examples of a wireless speaker include a Bluetooth speaker, a Wi-Fi speaker, or a combination Bluetooth and Wi-Fi speaker. A wireless speaker 70 may be weatherproof or non-weatherproof. A wireless speaker 70 may rely, for example, on AC power, battery power, solar power, or a combination of the foregoing.

One of ordinary skill in the art would recognize that Wi-Fi provides high-speed access to the internet for devices up to 300 feet away. Wi-Fi speakers connect to a home network, rely on AC power, work with multiple devices, and provide superior sound quality. As known in the art, Bluetooth is a wireless technology standard that is used to exchange data between Bluetooth-enabled devices over relatively short distances (less than 30 feet). Bluetooth speakers are compact, battery-powered units that are suitable for use to stream audio from a device to a single speaker. Bluetooth chips are incorporated into almost every modern mobile device or computer and require no network, meaning that Bluetooth will work almost anywhere.

An audio device 80 preferably communicates wirelessly with the speaker 70 so that the speaker 70 is capable of delivering sound to the user. Non-limiting examples of the audio system for Wi-Fi speakers include a Wi-Fi compatible stereo, smart television, computer, smart phone, and a tablet. Non-limiting examples of the audio system for Bluetooth speakers include a Bluetooth-enabled television, computer, smart phone, and a tablet. The audio device 80 may be part of the present invention, or may be separate from the present invention, in different embodiments.

Figure 3:
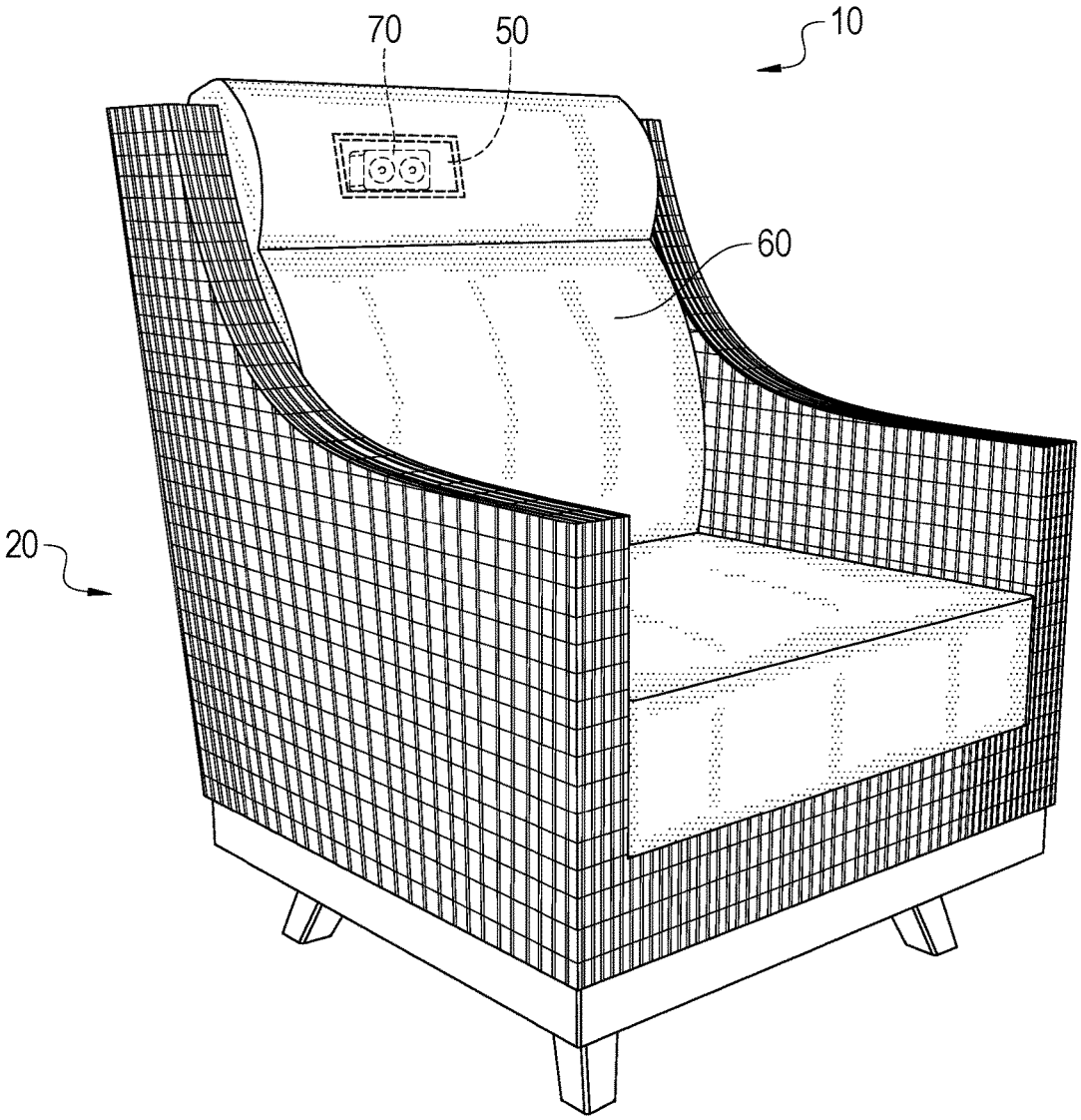
FIG. 3 shows a chair with an inset space that houses a wireless speaker obscured by a seatback cushion.

In an embodiment shown in FIG. 3, a seating and audio system 10 comprises a chair 20 comprising a seatback 40 and a seatback cushion 60 and a wireless speaker 70, said seatback 40 comprising an inset space 50, said inset space 50 open toward the seatback cushion 60 and said wireless speaker 70 positioned in said inset space 50 and capable of communicating wirelessly with a separate audio device 80, so that said wireless speaker 70 is capable of providing sound while hidden from view when communicating wirelessly with the separate audio device 80. The audio device 80 may be separate from the chair 20 or it may be included with the seating and audio system 10. One advantage of obscuring the inset space 50 housing the speaker 70 is that it is more aesthetically pleasing for the speaker 70 to be hidden from view. Another advantage of hiding the inset space 50 behind a cushion 60 is that the cushion 60 retains the speaker 70 within the inset space 50, decreasing the chance that the speaker 70 may accidentally fall out of the inset space 50, damaging the speaker 70. A further advantage of the cushion obscuring the inset space 50 housing the speaker 70 is that the speaker 70 may be protected from the weather. Additionally, in one embodiment a bladder composed of waterproof material 90 may be provided to fit within the inset space 50, with the bladder 90 having a closeable panel 100 which is opened during use of the speaker 70, but which is closeable during inclement weather.

Figure 4:
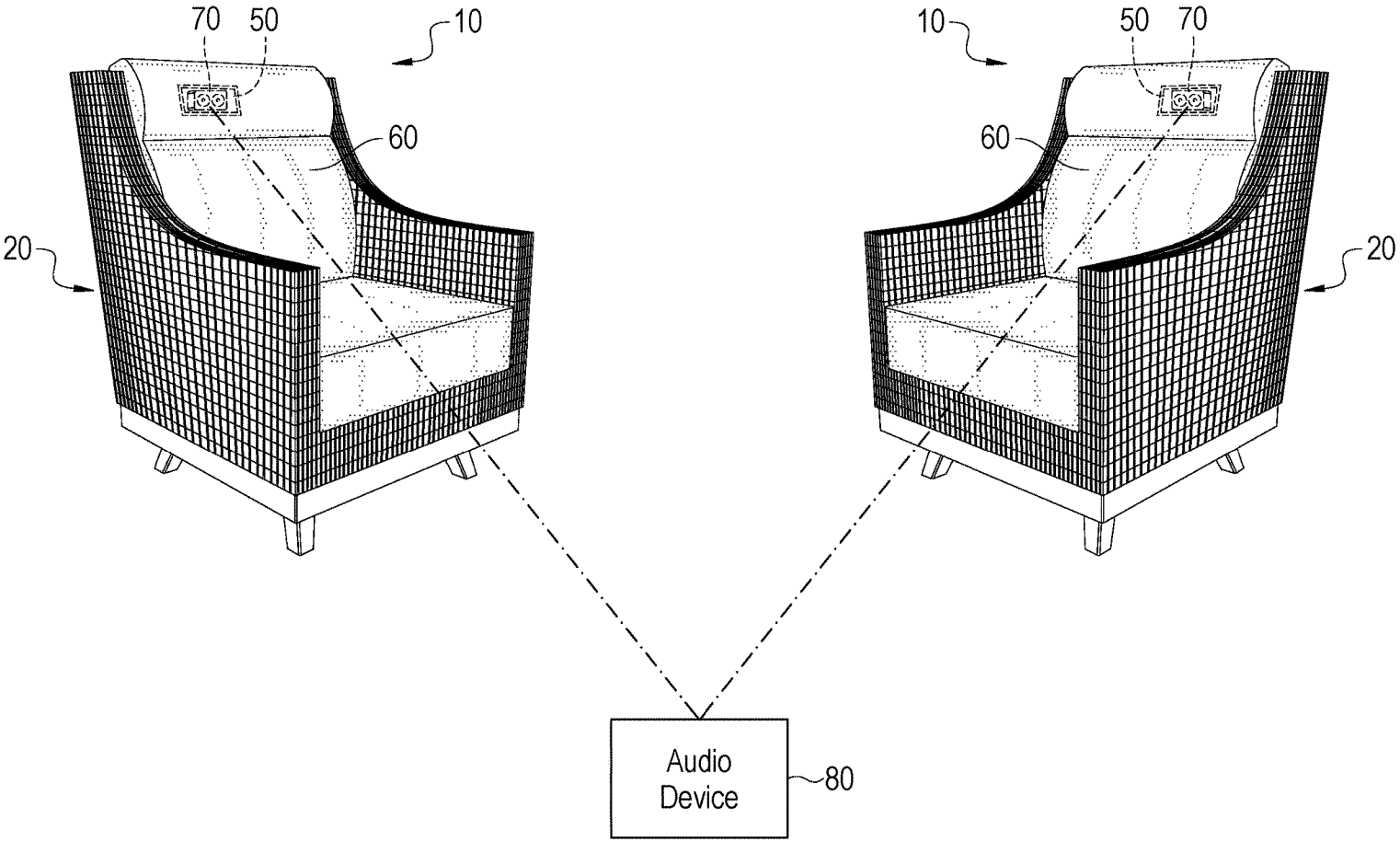
FIG. 4 shows a system of at least two chairs, each of said chairs housing a wireless speaker communicating wirelessly with an audio device, each chair having an inset space that houses a wireless speaker obscured by a seatback cushion.

In an exemplary embodiment shown in FIG. 4, an outdoor seating and audio system 10 comprises at least two chairs 20, at least two wireless speakers 70 and an audio device 80, each said chair 20 comprising a seatback 40 and a seatback cushion 60, each said seatback 40 comprising an inset space 50, each said inset space 50 open toward the seatback cushion 60 and each of said wireless speakers 70 positioned in one of said inset spaces 50 and communicating wirelessly with the audio device 80, so that each of said wireless speakers 70 are capable of providing stereo sound while hidden from view.

The audio device 80 may be separate from the chair 20 or it may be included with the seating and audio system 10.

An alternative embodiment (not shown) comprises at least two chairs 20 and at least two wireless speakers 70, each said chair 20 comprising a seatback 40 and a seatback cover 110, each said seatback 40 comprising an inset space 50 located adjacent to a flap 120 in each of said seatback covers 110, each said inset space 50 open toward one of the seatback covers 110 and each of said wireless speakers 70 positioned in one of said inset spaces 50 and communicating wirelessly with a separate audio device 80, so that each of said wireless speakers 70 can be accessed through one of said flaps 120 and can provide sound while hidden from view when communicating wirelessly with the separate audio device 80.

The audio device 80 may be separate from the chair 20 or it may be included with the seating and audio system 10.

It is desirable for each wireless speaker 70 in a grouping of two or more chairs 20 to communicate wirelessly with a single audio device 80 so that the same audio is provided to each speaker 70. By utilizing a single audio device 80 to communicate with multiple speakers 70, this allows the synchronization of the sound output for each speaker 70, enhancing the listening experience for each guest.

Figure 5:
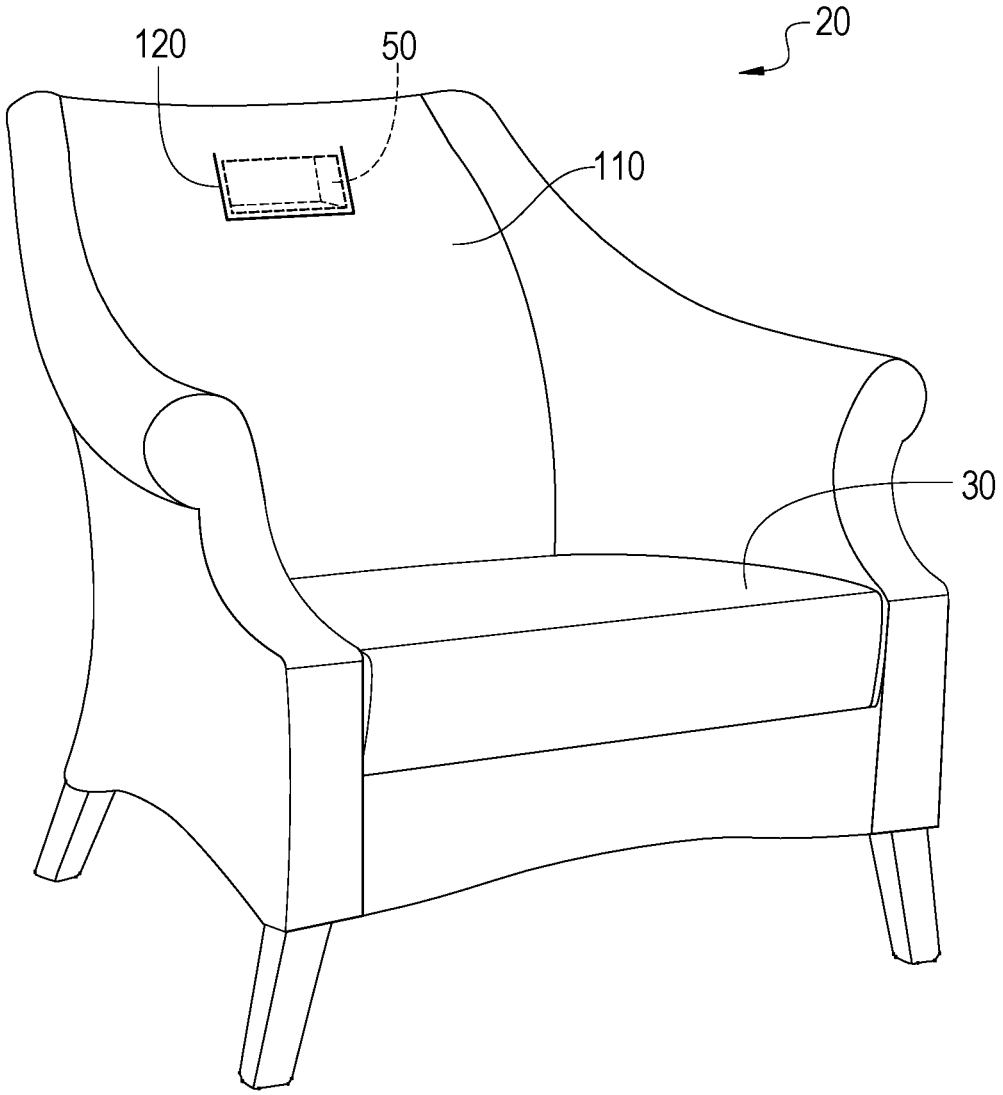
FIG. 5 shows a chair comprising an inset space, a seatback cover, and a flap, the flap in the closed position.
Figure 6:
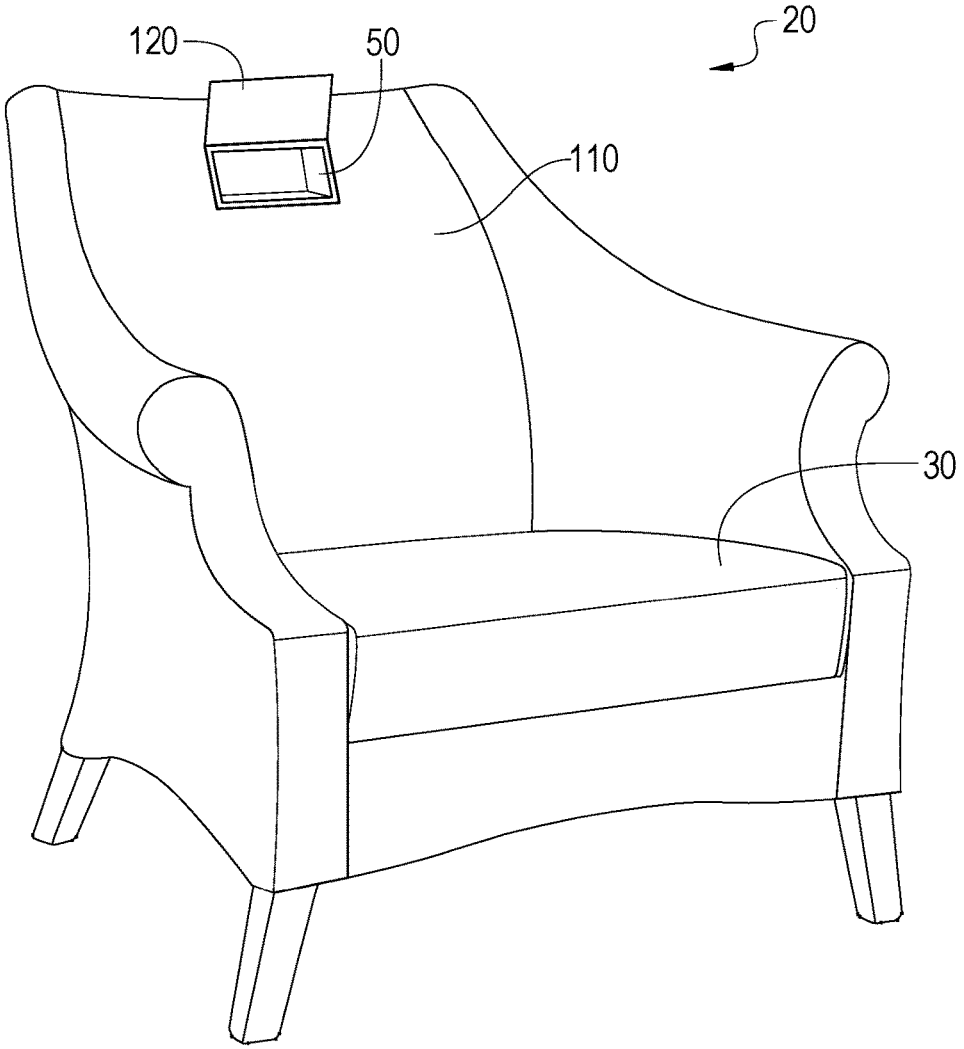
FIG. 6 shows a system having an inset space housing a wireless speaker, a seatback cover, and a flap in the open position.

In the embodiments shown in FIG. 5-6, a seating and audio system 10 comprises a chair 20 comprising a seatback 40 and a seatback cover 110, said seatback 40 comprising an inset space 50 located adjacent to a flap 120 in said seatback cover 110, said inset space 50 open toward the seatback cover 110. A wireless speaker 70 (not shown) may be positioned in said inset space 50 and communicate wirelessly with an audio device 80 (not shown), so that said wireless speaker 70 can be accessed through the flap 120 and can provide sound while hidden from view when communicating wirelessly with the audio device 80. The audio device 80 may be separate from the chair 20 or it may be included as part of the seating and audio system 10. In other embodiments, the inset space may be located in any other convenient location.

The seatback cover 110 rests on, or is integral to, the front and/or the back of the seatback 40. The seatback cover 110 provides similar advantages to the seatback cushion 60 in that it hides the inset space when the access flap 120 is closed. The seatback cover 110 can be any seatback cover known in the art. Non-limiting examples include a natural cloth seatback cover and a synthetic material seatback cover (e.g., plastic).

The seatback cover 110 includes a flap 120 adjacent to the open side of the inset space 50. By locating the flap 120 on the same side of the seatback 40 as the open side of the inset space 50, this allows the user to easily access the speaker 70 to adjust the controls of the speaker 70, for instance (e.g., volume and sound quality). In one embodiment, the flap 120 is on the side of the seatback 40 corresponding to the user's back. In one embodiment, the flap 120 is on the side of the seatback 40 that does not correspond to the user's back.

What is claimed is:

1. A seating and audio system comprising at least two outdoor chairs and at least two wireless speakers, each of said at least two outdoor chairs comprising a seatback and a seatback cushion, each said seatback comprising an inset space, each said inset space built into the seatback at shoulder blade level of a user when seated and opening toward the seatback cushion, and each of said at least two wireless speakers positioned in said inset space and communicating wirelessly with a separate audio device, so that said at least two wireless speakers are configured to provide stereo sound while hidden from view when communicating wirelessly with the separate audio device.

2. The seating and audio system as in claim 1, wherein at least one of the inset spaces is built into a center of one of said seatbacks.

3. The seating and audio system as in claim 1, wherein at least one of said inset spaces comprises a bladder of waterproof material comprising a closeable panel opening toward one of the seatbacks, so that at least one of the wireless speakers is capable of being protected during inclement weather when the closeable panel is closed.

4. The seating and audio system as in claim 1, wherein at least one of the wireless speakers comprises control function keys and a waterproof cover for said control function keys, said waterproof cover allowing the user to operate said control function keys without removing said waterproof cover.

5. A seating and audio system comprising at least two outdoor chairs and at least two wireless speakers, each of said at least two outdoor chairs comprising a seatback and a seatback cover, each said seatback comprising an inset space built into said seatback and adjacent to a flap in each of said seatback covers, each said inset space comprising a bladder of waterproof material and opening toward one of the seatback covers and each of said at least two wireless speakers positioned in said inset space and communicating wirelessly with a separate audio device, so that each of said at least two wireless speakers can be accessed by a user through said flap and can provide sound while hidden from view when communicating wirelessly with the separate audio device.

6. The seating and audio system as in claim 5, wherein at least one of the inset spaces is built into a center of one of said seatbacks.

7. The seating and audio system as in claim 5 wherein at least one of the inset spaces is built into one of the seatbacks approximately at shoulder blade level of the user when seated.

8. The seating and audio system as in claim 5, wherein at least one of the wireless speakers comprises control function keys and a waterproof cover for said control function keys, said waterproof cover allowing the user to operate control function keys without removing said waterproof cover.

9. The seating and audio system as in claim 5, wherein at least one of the inset spaces is built into one of the seatbacks at shoulder blade level of the user when seated.

10. A seating and audio system comprising at least two outdoor chairs, at least two wireless speakers and an audio device, each of said at least two outdoor chairs comprising a seatback and a seatback cushion, each said seatback comprising an inset space, each said inset space built into the seatback at shoulder blade level of a user when seated and opening toward the seatback cushion, and each of said at least two wireless speakers positioned in said inset space and communicating wirelessly with the audio device, so that said at least two wireless speakers are configured to provide stereo sound while hidden from view.

11. The seating and audio system as in claim 10, wherein at least one of the inset spaces is built into a center of one of said seatbacks.

12. The seating and audio system as in claim 10, wherein at least one of said inset spaces comprises a bladder of waterproof material comprising a closeable panel opening toward one of the seatbacks, so that at least one of the wireless speakers is capable of being protected during inclement weather when the closeable panel is closed.

13. The seating and audio system as in claim 10, wherein at least one of the wireless speakers comprises control function keys and a waterproof cover for said control function keys, said waterproof cover allowing the user to operate said control function keys without removing said waterproof cover.

14. A seating and audio system comprising at least two outdoor chairs, at least two wireless speakers and an audio device, each of said at least two outdoor chairs comprising a seatback and a seatback cover, each said seatback comprising an inset space located built into said seatback and adjacent to a flap in each of said seatback covers, each said inset space comprising a bladder of waterproof material and opening toward one of the seatback covers and each of said at least two wireless speakers positioned in said inset space and communicating wirelessly with the audio device, so that each of said at least two wireless speakers can be accessed by a user through said flap and can provide sound while hidden from view.

15. The seating and audio system as in claim 14, wherein at least one of the inset spaces is built into a center of one of said seatbacks.

16. The seating and audio system as in claim 14 wherein at least one of the inset spaces is built into one of the seatbacks approximately at shoulder blade level of the user when seated.

17. The seating and audio system as in claim 14, wherein at least one of the wireless speakers comprises control function keys and a waterproof cover for said control function keys, said waterproof cover allowing the user to operate said control function keys without removing said waterproof cover.

18. The seating and audio system as in claim 14, wherein at least one of the inset spaces is built into one of the seatbacks at shoulder blade level of the user when seated.

* * * * *